United States Patent [19]

Schinle

[11] Patent Number: 5,073,996

[45] Date of Patent: Dec. 24, 1991

[54] SHOWER APPARATUS

[75] Inventor: Otto Schinle, Schiltach, Fed. Rep. of Germany

[73] Assignee: Hans Grohe GmbH & Co. KG, Fed. Rep. of Germany

[21] Appl. No.: 465,950

[22] Filed: Jan. 16, 1990

[30] Foreign Application Priority Data

Jan. 17, 1989 [DE] Fed. Rep. of Germany ..... 3901162

[51] Int. Cl.[5] ..... A47K 3/22

[52] U.S. Cl. ..... 4/601; 4/605; 4/614

[58] Field of Search ..... 4/601, 605, 597, 612, 4/613, 614

[56] References Cited

U.S. PATENT DOCUMENTS

| | | | |
|---|---|---|---|
| 439,793 | 11/1890 | Taylor | 4/601 |
| 585,439 | 6/1897 | Hooper | 4/601 |
| 596,115 | 12/1897 | Jendis | 4/601 |
| 1,747,838 | 2/1930 | Mullett et al. | 4/601 |
| 2,336,402 | 12/1943 | Kaiser | 4/601 |
| 2,487,515 | 11/1949 | Bower | 4/601 X |
| 2,527,852 | 10/1950 | Rinehimer | 4/596 |
| 3,609,773 | 10/1971 | Mustee | 4/605 |

FOREIGN PATENT DOCUMENTS

| | | | |
|---|---|---|---|
| 327041 | 8/1989 | European Pat. Off. | 4/597 |
| 344588 | 12/1989 | European Pat. Off. | 4/612 |
| 1164049 | 2/1964 | Fed. Rep. of Germany . | |
| 1404713 | 11/1968 | Fed. Rep. of Germany . | |
| 2717648 | 9/1978 | Fed. Rep. of Germany . | |
| 19112 | 12/1981 | Fed. Rep. of Germany . | |
| 3211436 | 9/1983 | Fed. Rep. of Germany . | |
| 3400962 | 8/1984 | Fed. Rep. of Germany . | |
| 8804540 | 8/1988 | Fed. Rep. of Germany . | |
| 2552648 | 4/1985 | France . | |
| 581169 | 8/1958 | Italy | 4/612 |
| 2116031 | 9/1983 | United Kingdom | 4/597 |
| 8704059 | 7/1987 | World Int. Prop. O. | 4/612 |

OTHER PUBLICATIONS

Deutsche Bauzeitschrift, vol. 37, No. 3, Mar. 1989, pp. 266-267, "Der Duschtempel".

*Primary Examiner*—Henry J. Recla
*Assistant Examiner*—Robert M. Fetsuga
*Attorney, Agent, or Firm*—Eckert Seamans Cherin & Mellott

[57] ABSTRACT

The invention relates to a shower apparatus, particularly a shower cubicle, which has at least one laterally arranged, substantially vertically directed column, which in the upper region is connected to at least one further support, the connection between said column and the further supports being at least partly water-carrying and supporting at least one overhead shower.

21 Claims, 3 Drawing Sheets

SHOWER APPARATUS

FIELD OF THE INVENTION

The invention relates to a shower means, particularly a shower cubicle, preferably for private households.

SUMMARY OF THE INVENTION

An object of the invention is to provide a shower means, which is largely independent of the spatial circumstances and can easily be adapted to the space. This object is achieved by a shower means having at least one laterally positioned, substantially vertically directed column, which in the upper region is connected to at least one further support. The connection between the column and the further support at least partly carries water and carries at least one, particularly central overhead shower or sprinkler, which is preferably arranged symmetrically to the center of the connection. As a result of this construction and the separation of the overhead shower from existing walls or ceilings of rooms, the inventive shower means is universally usable.

The "column" is preferably a substantially hollow support made from metal or plastic.

In the case of the shower means according to the invention, if desired, the water supply can take place directly into the overhead shower or via the connection carrying the overhead shower, i.e. in the upper region. However, it preferably takes place by means of the aforementioned column and, as a function of the local conditions, laterally and substantially from below.

As the further support in the case of the shower means according to the invention, e.g. a wall or a room corner is used and to it can be fixed the connection. However, preferably at least one further support is formed by at least one further column. The supports of the inventive shower means can also consist exclusively of columns. There are e.g. two to six and preferably four such columns, whose reciprocal arrangement can be fundamentally chosen at random.

The shower means is preferably constructed in building set form and can be assembled from prefabricated, and in particular, preassembled modular components. Thus, the columns, the connections, the connecting walls for the columns, and/or optionally, the shower trays can be constructed as modular components.

According to a preferred embodiment, at least one of the columns of the inventive shower means is at least zonally water-carrying and is provided with at least one lateral shower or sprinkler and/or hand-held shower or sprinkler. For the operation of the individual showers, at least one of the columns of the inventive shower means is provided with at least one control and/or reversing fitting, particularly a shower head and/or lateral shower and/or hand-held shower reversing device. The control and/or reversing fitting is advantageously provided with a mixer, particularly in the form of a thermostatically operating mixer. It can be constructed as a mixer valve and is preferably positioned upstream of the reversing device. However, the fitting and the mixer valve, can also be combined.

For easier adaptation to local conditions and in particular for adjustment purposes, preferably at least one column, and in particular, all the columns of the inventive shower means have a vertically adjustable floor or ground support associated with them.

The inventive shower means can be directly installed on a floor, e.g. the tiled floor of a bathroom, so that the columns stand on the floor and can if desired be provided with a shower tray or tub. According to a preferred embodiment, a shower or bath tub is provided, and to the edge thereof, the columns of the shower means are fixed in a detachable manner and particular reference will be made thereto in the following description.

For the detachable fixing of the columns, it is possible to provide centering devices, on which the columns can be engaged, and in particular, slipped on. Such centering devices can be fixed both to the floor and to the tub edge or rim.

If a shower tub is provided and the shower means columns are located on the edge of said tub, it is possible to advantageously provide adjustable supports, associated with the columns below the tub edge, which can be constructed in such a way that they can be simultaneously used for the vertical adjustment of the columns.

The columns of the inventive shower means preferably have a prismatic construction, i.e. they preferably have a through, constant and preferably substantially circular or square cross-section and are preferably constituted by tubes, particularly plastic tubes. Their diameter can be in the range 10 to 30 cm.

The columns of the shower means according to the invention can be constructed in such a way that they can serve to enclose water pipes and/or electric lines or cables, the latter serving to supply optionally provided control devices and/or electrical appliances, such as electric thermostats, indicators, lights, radios and/or telephones. A hot-air blower can also be provided.

The inventive shower means, particularly in tiled rooms, can be installed without shower walls. However, at least on one side and preferably on three sides the shower means has walls, which interconnect preferably at least one column and the at least one support, accompanied by the formation of a shower cubicle. The shower cubicle can advantageously have a door in one of its walls or which can form one wall. The cubicle walls are preferably transparent, being made from glass or plastic. For the easier installation of the cubicle walls, the supports of the inventive shower means, preferably formed in each case by columns, can have vertically directed slots or stops, into which the cubicle walls can be inserted or engaged prior to the final assembly.

The walls can be planar, but are preferably arcuate if there are only two or three columns for the shower cubicle. Generally, the shower cubicle has four columns, if they are installed in self-supporting manner, and one to two columns, if they are installed in a corner or on a wall of an existing shower room.

At least one of the columns of the inventive shower means can have a receptacle or depository for shower accessories. In a preferred embodiment, it is formed by a correspondingly shaped recess.

As has already been stated, the inventive shower means can have additional indicator devices, which are preferably installed in a column. The indicators are, in particular, those for indicating the temperature, such as the water or air temperature, the flow quantity and/or the time.

The column having the control and/or reversing fitting is preferably located on the entrance side of the shower means and, if the shower cubicle is provided with a door, at the point where the door opens. As a result, the control fitting and reversing fitting are easily accessible from the outside. However, it is also possible to provide additional controls and, preferably also, indicators outside the shower cubicle, particularly on the outside of the latter. The fittings can then be controlled, and the indicators read without entering the shower or opening the door. This can be desirable if a specific shower temperature is to be set before the person takes a shower.

The connection between the columns or between the columns and other supports, in a preferred embodiment exclusively takes place radially, starting from a central joint or intersection. This means that the connecting arms pass radially or in manifold-like manner from said joint to the individual supports or columns. They are preferably fixed to the upper column end. The connections are preferably formed by tubes, particularly metal tubes. They can be welded together, but are preferably screwed to one another or are joined together by clamping or plug connections, in order to increase the variability within the building set. The diameter of the tubes of the connections is generally smaller than that of the columns and is generally ¼ to 1/10 of the column diameter. The connecting tubes are constructed for receiving water pipes and/or electric cables. In particular, the connecting tube, which passes from the column having the control and reversing fittings to the central junction or joint, generally contains the largest number of lines, because it must enclose not only the water-carrying pipes to the overhead shower, but also the water-carrying pipes for the lateral showers in other columns, as well as possibly electric cables for the lights in the individual columns, etc.

In each column, there can be at least two and preferably three to four lateral showers. The column having the control and reversing fittings can also have lateral showers. The hand-held shower is preferably located on the column having the control and reversing fittings and is connected thereto by means of a flexible hose. In general, one centrally positioned overhead shower located below the junction of the connections is sufficient. In place of or in addition to this centrally positioned overhead shower, further such overhead showers can be provided radially around the central intersection on the connecting tubes. The connections, particularly the connecting tubes are constructed as a reinforcement for the columns and fix the upper ends thereof. The connections are preferably arcuate and form a type of roof frame over the shower means, which can have an arcuate or pyramidal construction.

According to a particularly preferred embodiment of the invention, all the controls, indicators, additional devices, shower fittings, etc. are located on the columns or connections. Thus, the walls of the room in which the shower means is located, and which optionally serve as further supports, can remain free from such fittings and need not be modified. However, there can also be water supply pipes and/or electrical leads passing from the walls, if, in special cases, it is not possible to have a supply within the columns from below, as is normally the case.

BRIEF DESCRIPTION OF THE DRAWING

Further details, features and advantages of the invention, which can be realized singly or in the form of combinations in an embodiment of the invention, can be gathered from the claims and the following description of preferred embodiments in conjunction with the drawings, wherein:

DETAILED DESCRIPTION OF THE PREFERRED EMBODIMENTS

Figure 1:
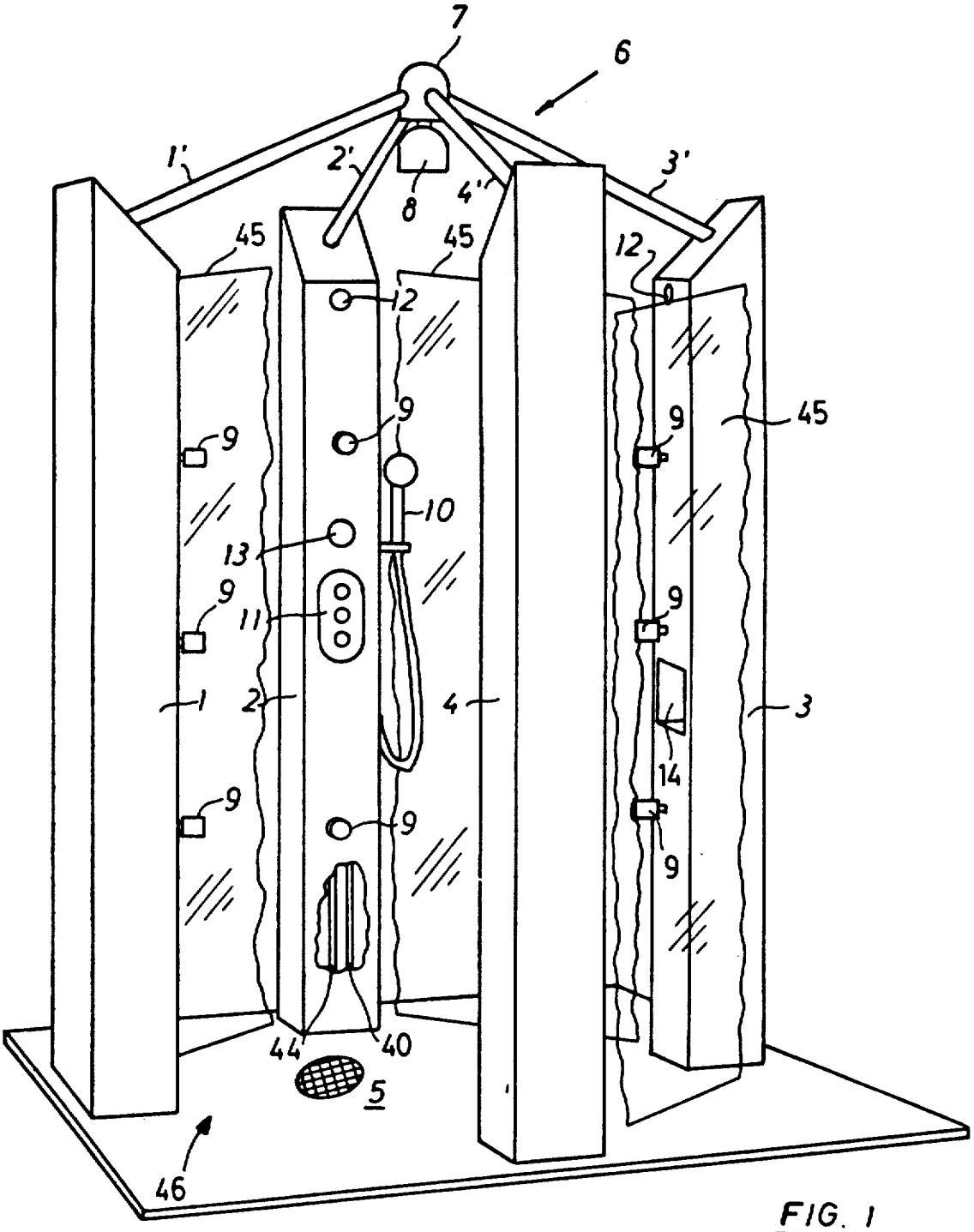
FIG. 1 shows a perspective, overall view of an embodiment of an inventive shower means, wherein interconnecting walls are shown broken away from the associated columns.

The shower means shown in FIG. 1 has four vertically directed, self-supporting columns 1 to 4 each arranged in a corner of an imaginary square and which are installed on a floor plate 5, e.g. the tiled floor of a bathroom and in each case have a through, constant square cross-section.

In the upper region, the four columns 1 to 4 are inwardly bevelled and are interconnected by means of a cross-shaped connecting piece 6. The latter has four radially directed tubes 1' to 4', which issue into a central intersection or joint 7, to the bottom of which is fixed an overhead shower 8.

The four columns 1 to 4 are hollow and, as will be described hereinafter, in each case, carry water. Three of then are equipped within each case, three lateral showers 9, the fourth with two lateral showers 9, a hand-held shower 10 and a fitting 11, by means of which the individual showers 8, 9 and/or 10 are operated and the quantity and temperature of the water passing out of them can be adjusted by the user. In the upper region's, each of the four columns 1 to 4 has small lights 12, which are operated by a switch 13 on column 2. One of the columns 3 has an inwardly open recess 14, which can be used by the user for depositing shower utensils.

The inventive shower means, particularly in tiled rooms, can be installed without shower walls. However, at least on one side, and preferably on three sides, the shower means has walls 45, which interconnect preferably at least one column 2 and the at least one support 1, accompanied by the formation of a shower cubicle. The shower cubicle can advantageously have a door 46 in one of its walls or can form one wall. The cubicle walls 45 are preferably transparent, being made from glass or plastic. For the easier installation of the walls 45, the supports of the inventive shower means, preferably formed in each case by columns 1–4, can have vertically directed slots or stops, into which the cubicle walls 45 can be inserted or engaged prior to the final assembly.

The walls 45 can be planar, but are preferably arcuate if there are only two or three columns for the shower cubicle. Generally, the shower cubicle has four columns 1–4, if they are installed in self-supporting manner, in one to two columns, if they are installed in a corner or on a wall of an existing shower room.

Figure 2:
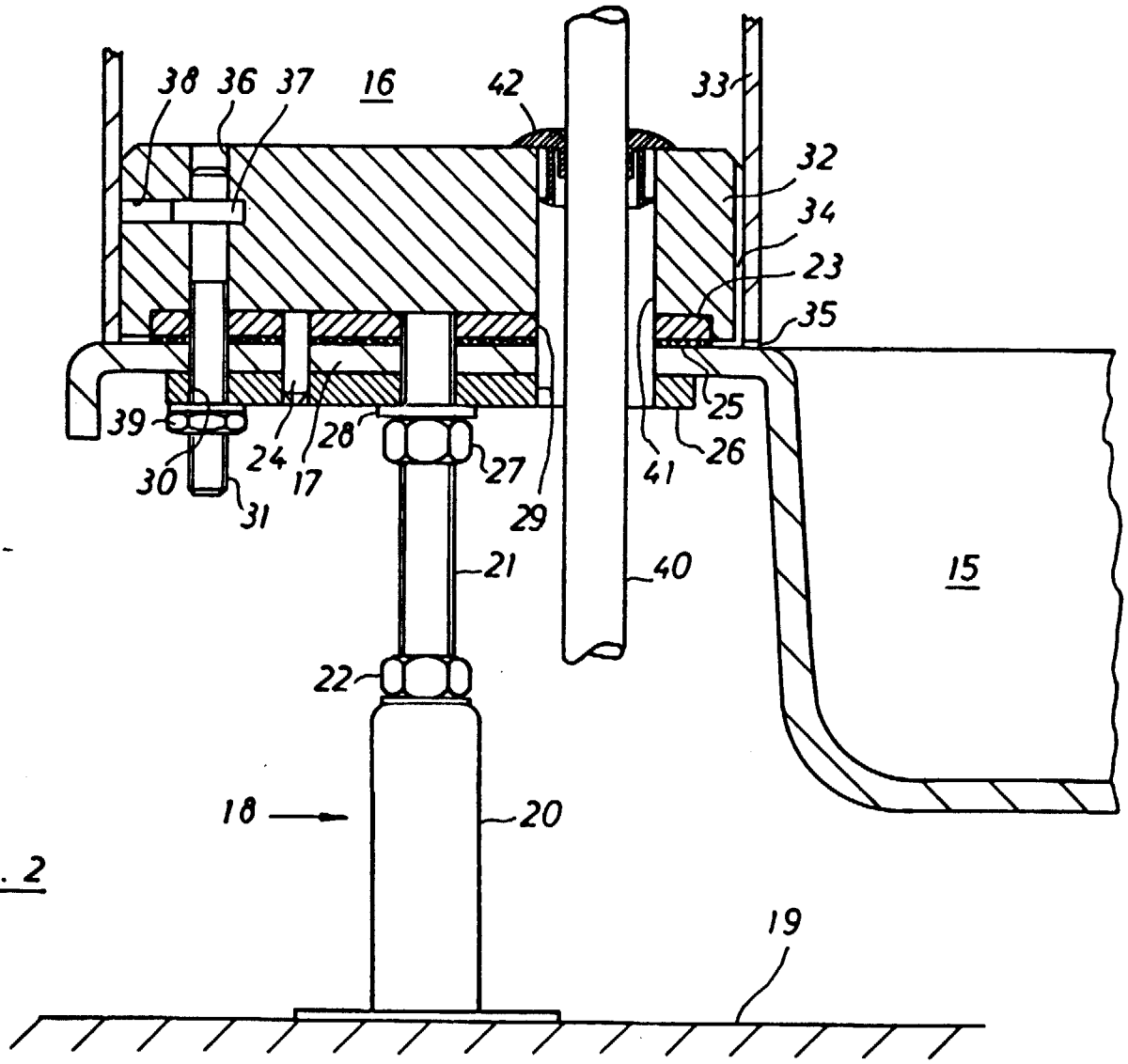
FIGS. 2 and 3 show sectional partial views of another embodiment of the inventive shower means.
Figure 3:
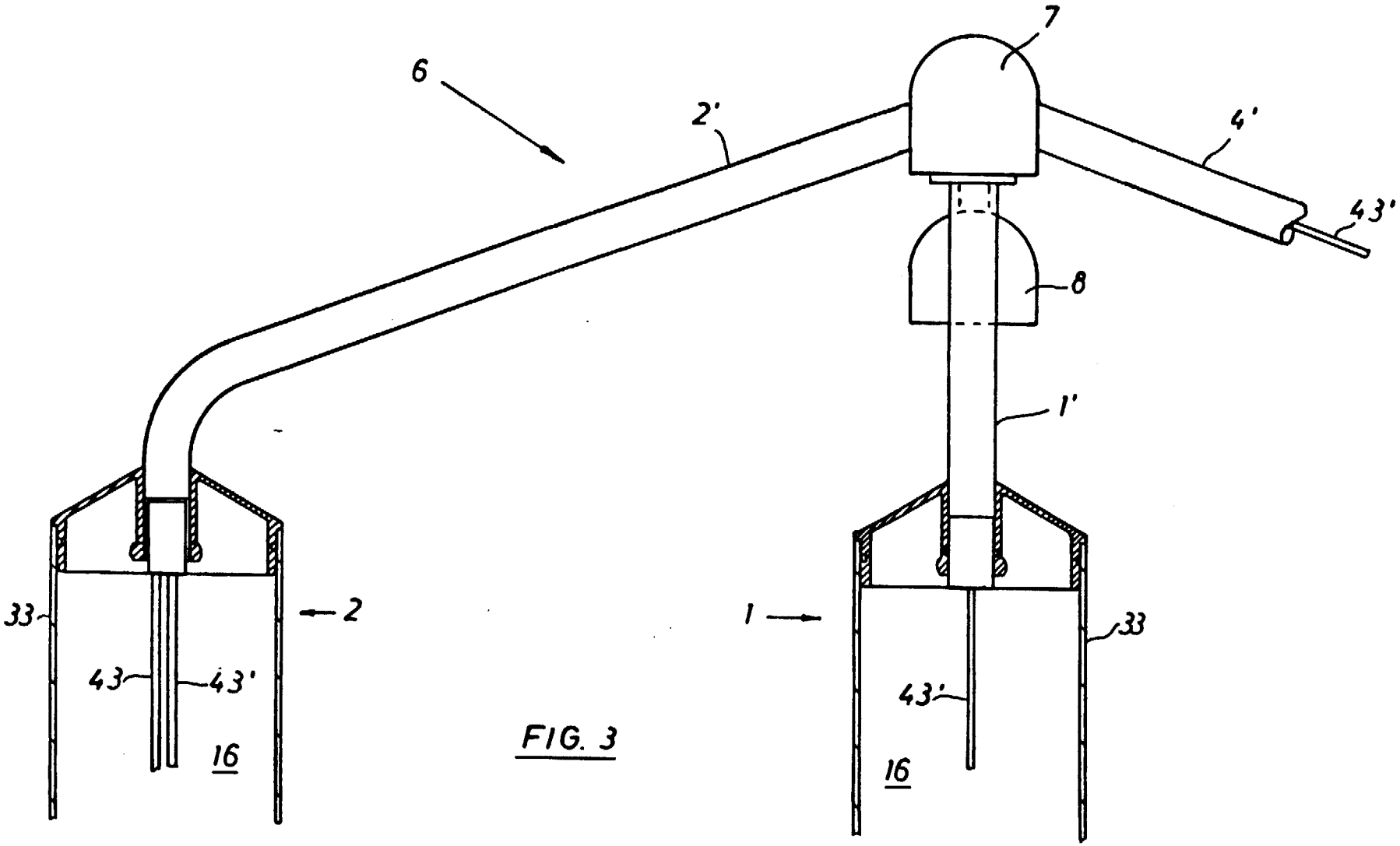

The four columns 1 to 4 shown in FIG. 1 are, as stated, mounted on the floor 5. However, if desired, they could also be fixed to the edge or rim of a correspondingly dimensioned shower tub. Such a shower tub 15 is provided in the embodiment, whereof FIGS. 2 and 3 show part sectional partial views. Diverging from the embodiment shown in FIG. 1, in the case of the embodiment shown in partial view form in FIGS. 2 and 3 columns 16 are provided, which are, in each case, circular cylindrical in cross-section. In the case of the embodiment shown in partial view form in FIGS. 2 and 3, the shower tub 15 together with the column 16 fixed to its edge 17 forms a unit, supported by means of several vertically adjustable supports 18 on the floor 19 of e.g. a bathroom, the supports 18 being in each case so arranged below the tub edge 17, that they are aligned with the columns 16 positioned above the edge 17.

The supports 18 comprise a base part 20 with an internal thread, into which a bolt 21 can be screwed from above and which can be secured against twisting by means of a nut 22. On its end remote from the base part 20, the bolt 21 is rigidly connected to an adjusting plate 23. e.g. by welding. This adjusting plate 23, which could also be called the head of bolt 21, has a downwardly directed adjusting pin 24. Correspondingly dimensioned insertion holes are provided for pin 24 and bolt 21 in the edge 17 of shower tub 15, so that adjusting plate 23 cannot turn if, accompanied by the interposing of a resilient rubber washer 25 and placing on the edge 17 of shower tub 15, oriented in such a way that the adjusting pin 24 and bolt 21 project through the holes provided in edge 17. Below the edge 17 of tub 15 is provided a mating plate 26 having the insertion holes for the adjusting pin 24 and openings corresponding to the bolts 21. A nut 27 with shim 28 screwed onto the bolt 21 is provided for securing the mating plate 26.

The edge 17 of shower tub 15 and the plates 23, 26 engaging at the top and bottom in the vicinity of each support 18 in the installed state have aligned, eccentric openings, namely a relatively large opening 29, shown to the right in FIG. 2, for the passage of a water-carrying pipe and an electric cables 44 and two openings 30, whereof only one is shown in FIG. 2. In conjunction with fastening bolts 31, the openings 30 serve to fasten a relatively thick flange 32, which forms the lower termination of column 16.

Prior to the installation of the shower tub 15, which can e.g. be made from plastic, it is firstly provided with several supports 18, whose number corresponds to the number of columns to be subsequently fixed to edge or rim 17. The following procedure is adopted. First, with the aid of a template, corresponding holes are drilled at the points of the bath rim on which the columns are to be supported. Subsequently, the washer 25 is placed on bolt 21 and is so oriented that the adjusting pin 24 penetrates through the opening associated therewith in the washer 25. The bolt 21 is then passed through the hole provided for it in the edge 17 of tub 15 and by turning the adjusting plate 23 is so oriented that its adjusting pin 25 is aligned with the opening associated with it in tub edge 17 and can be inserted therein. When this has taken place, the mating plate 27 is engaged on bolt 21 and oriented with respect to adjusting pin 24, so that it can also be secured against turning. The shim 28 is then fitted and the nut 27 screwed down and tightened. When this has taken place, a nut 22 and base part 20 are screwed onto the free end of bolt 21. When all the supports 18 have been correspondingly fitted, the shower tub 15 can be installed and adjusted. The latter is easily possible by rotating one and/or other base part 20 and which is prevented from subsequent loosening by the associated nut 22.

The columns 16 have a tubular plastic jacket 33 and, as stated, they are terminated at the bottom by a flange 32 in each case. Flanges 32 have recesses open towards the edge 17 of tub 15 and their dimensions correspond to those of the adjusting plate 23, so that, on mounting the columns 16 on adjusting plates 23, the flanges 32 can be adjusted until the jacket 33 of the columns comes into contact with the top of the edge 17 of tub 15. The flanges 32 are fixed in the columns 16, preferably by bending or screwing. In order to prevent the formation of condensation water within the columns 16 which would not be able to flow away, each of the flanges 32 has at least one groove 34, which is vertically directed following the installation of the columns 16, and the jacket has a small outlet 35 linked thereto.

When the columns 16 have been mounted on their associated adjusting plates 23, they can be very simply kept in this position by the aforementioned fixing bolts 31 for which insertion openings 36 are provided in flanges 32. To prevent any loosening of fixing bolts 31, locking pins 37 are provided, and for these, correspondingly dimensioned insertion holes 38 are provided in flanges 32. Prior to the fixing of flanges 32, the fastening bolts 31 are fixed in the column jackets 33 and their length is dimensioned in such a way that, following the installation of the columns, they project through the adjusting plate 33, washer 25, tub edge 17 and mating plate 26 and can be secured against dropping out from below by means of a nut 39.

Within column 16, corresponding to column 2 in FIG. 1, are provided two water pipes 40, whereof only one is visible in FIG. 2. One of these pipes 40 is used for supplying cold water and the other for supplying hot water. For both of the pipes 40, which are preferably plastic or metal pipes, through holes 41 are provided in flange 32 and are aligned with correspondingly dimensioned through holes in the edge 17 of tub 15 and the two plates 23 and 26, and are dimensioned in such a way that within the same, the pipes 40 can be sealed with respect to the flange by a profile ring seal 42. In column 16, corresponding to column 2 in FIG. 1, the water pipes 40 pass via a mixer valve to the aforementioned fitting 11. From there, separate water pipes 43, which contain thermostatically controlled mixed water, lead to the individual showers 8, 9 and 10. The hand-held shower 10 is supplied by means of its own water pipe. The remaining showers, i.e. the overhead shower 8 and lateral shower 9, are supplied by means of separate feed pipes 43 or 43'. These initially run in the interior of column 16 corresponding to column 2 in FIG. 1 and then through the pipe 2' connected thereto to the joint or intersection 7. From there, one pipe passes directly to the overhead shower 8 and via the manifold-positioned pipes 1', 3' and 4' to the columns associated therewith. An upper cross connection of the individual columns can be provided, but preferably does not then carry water. In the represented embodiments, the individual columns are preferably interconnected in the upper area by means of the manifold formed by the four pipes 1' to 4' and the junction 7 and it is preferably so constructed and arranged that the junction 7, following the installation of the manifold, is located above the upper column ends. The manifold formed by the four pipes 1' to 4' and the junction 7 is preferably constructed in such a way that, after preassembly and connection of the pipes located therein, it can be mounted as a unit on the upper column ends.

For producing interchangeable hot and cold showers, the reversing member or mixer valve can be set up in such a way that the shower temperature abruptly changes after predetermined intervals. It is also possible to provide booster pumps in the shower means, particularly below the edge of the shower tub and/or in the lower area of the columns.

I claim:

1. A shower, comprising:

an overhead shower head;

at least one hollow substantially vertical column, said column enclosing at least one water pipe for supplying water to said overhead shower head, said water pipe extending beyond an upper portion of said column and having an upper portion connected to said overhead shower head;

at least one support laterally arranged relative to said column;

at least one connecting member connected between said overhead shower head and said support, said connecting member supporting said overhead shower head in a shower interior; and at least one wall interconnected between said column and said support;

said wall, said column and said support defining a shower periphery having an external side opposite said shower interior, said wall connecting to a side of said column, a portion of said column being exposed on said exterior side.

2. A shower according to claim 2, characterized in that the support is at least one further column.

3. A shower according to claim 1, wherein is provided at least two additional columns and walls are connected between the columns.

4. A shower according to claim 1, characterized in that said column is provided with at least one lateral shower head connected to said water pipe and directed toward said shower interior.

5. A shower according to claim 4, wherein said lateral shower is a hand-held shower.

6. A shower according to claim 1, wherein the column is provided with at least one of a control and a reversing fitting.

7. A shower according to claim 6, wherein said column encloses and carries electric cables.

8. A shower according to claim 7, wherein said column is provided with a control and said electric cables supply electric power to said control on said column.

9. A shower according to claim 8, wherein the control activates at least one light.

10. A shower according to claim 1, wherein said column is circular in cross-section.

11. A shower according to claim 1, wherein the column is prismatic in cross-section.

12. A shower according to claim 1, wherein said column is a tube.

13. A shower according to claim 1, wherein said wall is transparent.

14. A shower according to claim 13, wherein said wall is glass.

15. A shower according to claim 1, wherein said support has a recessed receptacle for shower accessories.

16. A shower according to claim 1, wherein said water pipe and said connecting member are connected at a central intersection in said shower interior and extend radially outwardly to connect respectively to said column and said support.

17. A shower according to claim 1, wherein said water pipe is metal and has a diameter smaller than a diameter of said column.

18. A shower according to claim 1, wherein said water pipe and said connecting member are connected at an intersection in said shower interior for reinforcing said column and said support.

19. A shower according to claim 1, wherein said connecting member includes an arcuate portion.

20. A shower according to claim 1, wherein said shower is constructed as a building set and can be assembled from modular components.

21. A shower according to claim 1, wherein said column, connecting member, wall and a shower tray are constructed as modular components.

* * * * *